United States Patent [19]

Grottola

[11] 4,261,578

[45] Apr. 14, 1981

[54] RING TOSS GAME

[76] Inventor: Oresto P. Grottola, 930 S. Velare St., Anaheim, Calif. 92804

[21] Appl. No.: 70,409

[22] Filed: Aug. 27, 1979

[51] Int. Cl.[3] ..... A63B 67/06

[52] U.S. Cl. ..... 273/339

[58] Field of Search ..... 46/147; 272/54, 56, 272/74; 273/336, 337, 338, 339

[56] References Cited

U.S. PATENT DOCUMENTS

| | | | |
|---|---|---|---|
| 518,930 | 4/1894 | Allen | 273/336 |
| 1,270,219 | 6/1918 | Schwarz | 272/56 |
| 1,617,127 | 2/1927 | Levay | 273/339 |
| 2,009,625 | 7/1935 | Knorpp | 273/336 |
| 2,431,138 | 11/1947 | Ressinger | 272/54 |
| 3,272,509 | 9/1966 | Rogers | 273/337 |
| 3,586,330 | 6/1971 | Lema | 273/339 |

*Primary Examiner*—Harland S. Skogquist
*Attorney, Agent, or Firm*—Allen A. Dicke, Jr.

[57] ABSTRACT

Partially circular rocker is arcuately curved and has inwardly directed king pins positioned opposite from each other at the ends of the curve. One king pin is assigned to each competitor. Rings are tossed so that each competitor attempts to ring his own king pin and, at the same time, knock his competitor's ring off his competitor's king pin. A balance weight on the rocker is moved at each turn to level the rocker.

10 Claims, 4 Drawing Figures

RING TOSS GAME

BACKGROUND

This invention is directed to a ring toss game which has two king pins secured to a rocker so that, when competitors toss their rings onto their king pins, the rocket can rock to sometimes dislodge a competitor's ring.

There have been many games where a ring is tossed onto a pin. These games may have been initiated in response to the game of horseshoes. In horseshoes, two pins are set in the ground at a distance from each other, and opponents attempt to alternately toss their horseshoes onto a pin from a position adjacent the other pin. This is a well-liked game and is widely played, even today when real horseshoes are not readily available. Instead, stylized horseshoes useful only in the game are employed. However, there are two major disadvantages to the game. The first is the required distance between the pins when the game is set up in accordance with the standard rules. The second problem is that the horseshoes striking the ground around the pins cause considerable damage, and thus, the game cannot be played on lawns or other surfaces for which the appearance is important. Furthermore, there is no opportunity to play such a game indoors.

It may have been as a result of these disadvantages that the game of tossing rings onto pins came about. The usual ring toss games imitate horseshoes by having a pair of spaced upright pins over which rings are tossed. The rings used to be made of rope, and they are not often made of synthetic polymer composition tube or injection-molded rings. The rules are similar to those of horseshoes. Oftentimes, the pin is mounted on a portable base so that the game may be played without driving a pin, and, sometimes a single pin is used. Thus, many of the disadvantages of the game of horseshoes are overcome, but there has been little advance in the game itself. The present ring toss game provides advances in skills and development of new concepts.

SUMMARY

In order to aid in the understanding of this invention, it can be stated in essentially summary form that it is directed to a ring toss game having an arcuately curved rocker having an inwardly directed king pin adjacent each end of the rocker so that the pins substantially face each other. A plurality of rings is provided so that the rings can be tossed onto the king pins and dislodged from one of the pins by a proper toss onto the other of the pins so that opponents' rings can be knocked off.

It is thus an object of this invention to provide a ring toss game having a partially circular rocker carrying a pair of inwardly directed king pins so that the competitors can alternately toss their rings onto opposite pins. It is another object to provide a ring toss game wherein one competitor has the opportunity to knock his opponent's scoring rings out of scoring position. It is another object to provide a ring toss game wherein rocking of the curved rocker can cause dislodgment of rings on the pins carried thereon so that proper tossing of a ring can dislodge an opponent's scoring ring. It is a further object to provide a ring toss game wherein new skills, new concepts, and new rules are created.

Other objects and advantages of this invention will become apparent from a study of the following portion of the specification, the claims, and the attached drawings.

DESCRIPTION OF THE PREFERRED EMBODIMENT

Figure 1:
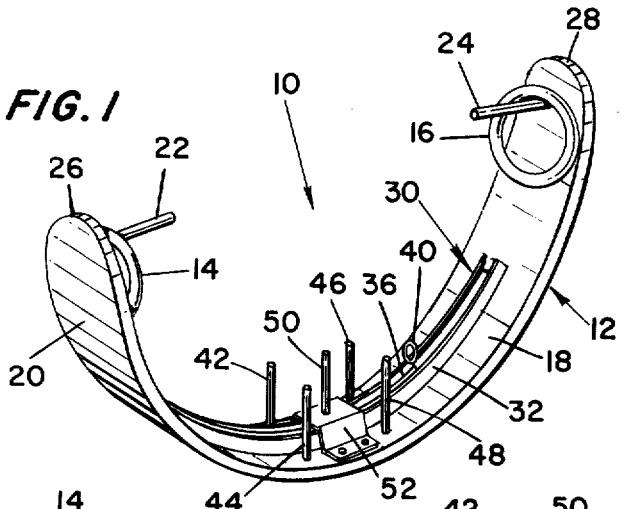
FIG. 1 is an isometric view of the ring toss game of this invention.
Figure 4:
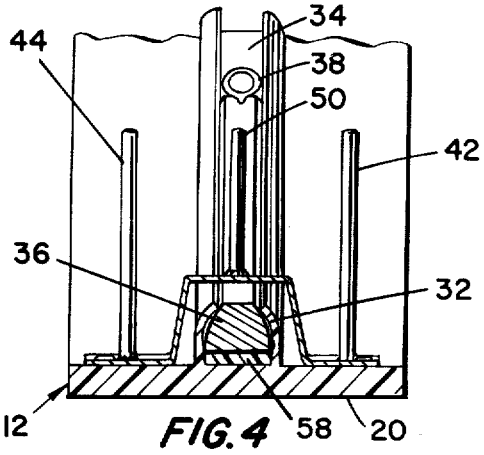
FIG. 4 is an enlarged section taken generally along the line 4—4 of FIG. 3.
Figure 2:
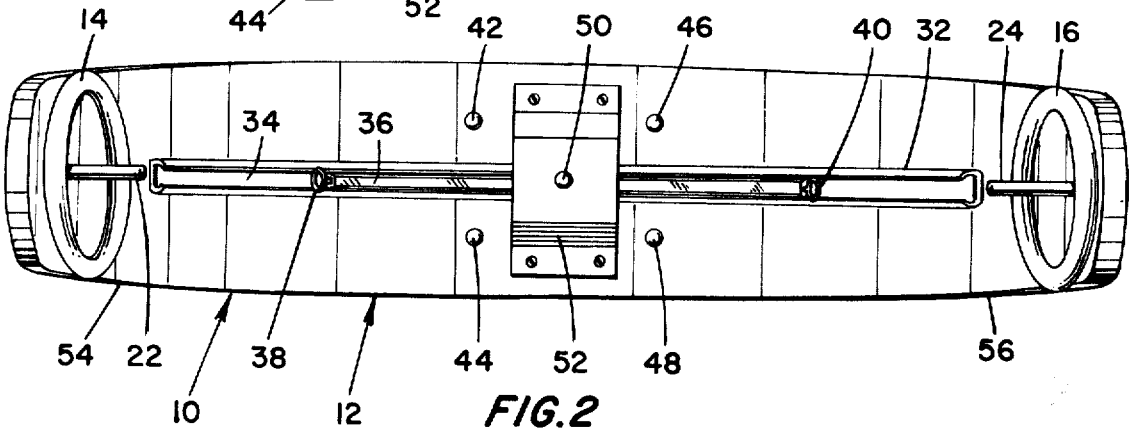
FIG. 2 is an enlarged plan view thereof.
Figure 3:
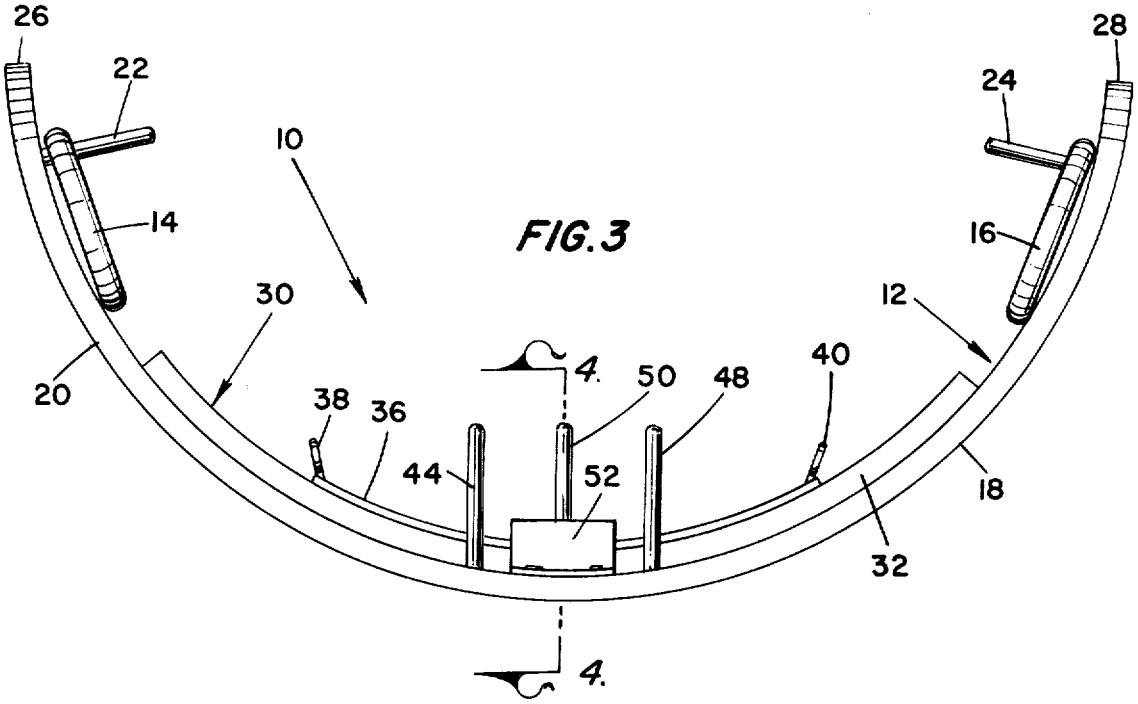
FIG. 3 is a side-elevational view thereof.

The ring toss game of this invention is generally indicated at 10 in FIGS. 1, 2 and 3. It comprises rocker 12 with its accoutrements and a set of rings of which two rings are shown at 14 and 16.

Rocker 12 is formed of rocker body 18 which has a curved exterior or bottom surface 20. The rocker is sized and shaped, and its exterior bottom surface 20 is shaped so that rocker 12 can rock. The rocker body is almost a half circle and can be formed of thermoplastic or other synthetic polymer composition material or can be formed by bending and laminating wood. While the interior surface does not need to be arcuately shaped, it is conveniently formed in an arc to conserve materials. Furthermore, it must be curved with a lower bottom than the upstanding ends, so a substantially uniform thickness of the rocker body is convenient.

King pins 22 and 24 are secured to the rocker body adjacent the upper ends 26 and 28 to extend inwardly, generally directed toward each other. When the rocker body is a circular curve, which is the preferred embodiment, the king pins 22 and 24 are mounted normal to the local surface so that they are radially directed. Pins 22 and 24 are dimensioned to receive a plurality of rings by being tossed thereon.

When a ring is tossed onto a king pin, the rocker 12 rocks and, if there is a different number of rings on one of the pins 22 or 24 as compared to the other one, then when the rocker stabilizes, it will not rest in a level position. In accordance with the preferred embodiment of this invention, it is desirable to have the rocker level whenever a ring toss turn is taken so that a leveling structure is provided. Leveling structure 30 is in the form of a track 32 which has an open slot 34 in the top. Sliding weight 36 is slidably movable in the track. Rings 38 and 40 are manually engageable for sliding the weight back and forth in its track. To ease sliding, a slippery member 42 such as a Teflon strip can be positioned in the bottom of the track or on the bottom of the sliding weight. When a different number of rings is on each of the pegs, the sliding weight is slid until the structure is level.

When there is a ring on one of the king pins 22 or 24 and the other player properly tosses his ring, then the first one becomes dislodged as a consequence of the rocking motion caused by the tossing of the other ring. When it is dislodged, it no longer counts score, but to further enhance the game and provide a random character to the result, scoring pins are provided in the lower center of the rocker body. Scoring pins 42 and 44 are provided on one side of the center, while scoring pins 46 and 48 are provided on the other side of the center. Additionally, scoring pin 50 is mounted directly in the center. In order to permit this position of mounting, it is mounted on bridge 52 which straddles the track 32 with its sliding weight 36.

In order to best understand the utility of the ring toss game 10, an example of its use in play and an example of game rules are given below. In order to permit competing players to distinguish, it is convenient to have visually distinguishing character for the various parts of the game. The left end 54 of rocker 12 will be called "the red end," and the right end 56 will be called "the blue end," although other colors and other types of distinguishing character could be alternatively used. King pin 22 is a red pin, and king pin 24 is a blue pin. Each player can play four rings, and thus there are four red rings given to the red player and four blue rings given to the blue player. For additional scoring, scoring pins 42 and 48 are blue, while scoring pins 44 and 46 are red. Center pin 50 is gold-colored and can be positively scored by either player.

A distance is agreed upon; for example, 8 feet from center pin 50, and the red player throws the first ring from the blue end onto the red pin 22. If he scores a ringer, this counts plus three points for him. Sliding weight 36 is moved to the right to relevel rocker 12. Now, the blue player tosses his blue rings from the red end onto blue pin 24. He may score a ringer on the pin, which counts three points for him, if he delivers his ring 16 sufficiently forcefully, rocker 12 rocks to the right sufficiently to dislodge the red player's ring 14. In this dislodgment, the ring 14 is tossed off of pin 22. The blue player gets an additional three points for knocking off the red ring. The red ring 14 may fall free, or it may engage over one or more of the scoring pins 42 through 50. If it engages over one of the red pins 42 or 46, then the red player gets two points. If it engages over one of the blue pins 42 or 48, then the blue player gets two points. If it engages over both a red and a blue pin (for example, pins 44 and 42), then both players get two points. If it engages over either a red pin and the gold center pin 50, then the red player scores five points. If it engages over one of the blue pins and the pin 50, then the blue player scores seven points—five for the gold and two for the blue. If it engages over both the gold pin 50 and both the red and blue pins, then both players score seven points. If only the gold pin 50 is ringed, then the player whose action causes the ringing gets five points. In other words, each of the scoring pins 42, 44, 46 and 48 on the base of the rocker body is worth two points to the person who has that color. In addition, the center gold pin 50 is worth five points.

The red and blue players alternately toss their respective red and blue rings until four rings are tossed by each. If a player has his king pin substantially filled and the length of each king pin 22 and 24 is long enough to accommodate three rings but not four, then he can attempt to gain additional score by throwing the fourth ring directly onto the base rings.

While only four rings can be tossed in one set of play, a fifth ring is provided for each player. This fifth ring is heavier and can be alternatively tossed by either of the players at his convenience. This fifth, heavier ring may have stripes thereon for identification and can be called the "anchor ring." It is thrown when more weight is needed. For example, when the opponent has two or three rings on his king pin, then the heavier anchor ring is necessary to dislodge them. Another tactic of play with the heavy, anchor ring is employed when the opponent has one or more of his rings on his king pin. Then, by tossing the anchor ring, one can attempt to toss the opponent's ring off of his king pin and onto the other king pin. This play wins the game automatically and is called a "Rock-A-Ringer" to provide the name for the game. Success of this tactic is similar to the success of a hole-in-one.

The game may be played by four players by having a two-man team at each end. The members of a team would alternate in their ring tossing.

As an example of particular dimensions which provide a ring toss game in accordance with this invention which can be employed both indoors and outdoors, the rocker body 18 is formed with a radius of 22-¼ inches with the upper ends 26 and 28 positioned on a chord with a 20 inch height. The rings are made of 1 -⅛ inch rubber tube formed to a ring of 8 inches diameter. King pins 22 and 24 extend 6 inches inward from the inner surface of rocker body 18. Base pins 42 through 48 extend upward the same amount. Center pin 50 terminates level with the top of base pins 42 through 48. In this way, the preferred size of the ring toss game 10 is achieved. However, it can be made in other sizes depending on the space available. With the smaller structure, it can be played closer and in more confined spaces.

This invention has been described in its presently contemplated best mode, and it is clear that it is sucepti-ble to numerous modifications, modes and embodiments within the ability of those skilled in the art and without the exercise of the inventive faculty. Accordingly, the scope of this invention is defined by the scope of the following claims.

What is claimed is:

1. A rocker for use with rings to form a ring toss game, said rocker comprising:

a rocker body having ends and having a curved bottom surface intermediate its ends, said rocker body being shaped so that it can rock on its curved bottom surface;

first and second king pins generally directed towards each other and positioned on said rocker body adjacent its ends so that, when a ring is placed on one of said king pins, said rocker rocks, said first and second king pins being directed so that when a ring is forceably tossed on the other of said king pins, said ring placed on said one of said king pins tends to be tossed off.

2. A rocker for use with rings to form a ring toss game, said rocker comprising:

a rocker body having ends and having a curved bottom surface intermediate its ends, said rocker body being shaped so that it can rock on its curved bottom surface, a leveling structure;

first and second king pins generally directed towards each other and positioned on said rocker body adjacent its ends so that when a ring is placed on one of said king pins, said rocker rocks and when said rocker is unbalanced by rings thereon, said rocker can be rebalanced by adjustment of said leveling structure.

3. The rocker of claim 2 wherein said leveling structure comprises a weight on said rocker body which is relatively movable with respect to said rocker body.

4. A rocker for use with rings to form a ring toss game, said rocker comprising:

a rocker body having ends and having a curved bottom surface intermediate its ends, said rocker body being shaped so that it can rock on its curved bottom surface, a leveling structure on said rocker body, said leveling structure comprising a weight on said rocker body which is relatively movable with respect to said rocker body;

first and second king pins generally directed towards each other and positioned on said rocker body adjacent its ends so that when a ring is placed on one of said king pins said rocker rocks;

base scoring pins secured to said rocker body intermediate the ends thereof, said base scoring pins being positioned and directed so that they can receive rings from said king pins.

5. A rocker for use with rings to form a ring toss game, said rocker comprising:

a rocker body having ends and having a curved bottom surface intermediate its ends, said rocker body being shaped so that it can rock on its curved bottom surface;

first and second king pins generally directed towards each other and positioned on said rocker body adjacent its ends so that when a ring is placed on one of said king pins said rocker rocks;

base scoring pins secured to said rocker body intermediate the ends thereof, said base scoring pins being positioned and directed so that they can receive rings from said king pins.

6. A ring toss game combination comprising:

a rocker, said rocker comprising a rocker body having ends and having a curved bottom surface intermediate its ends, said rocker body being shaped so that it can rock on its curved surface;

first and second king pins generally directed towards each other and positioned on said rocker body adjacent its ends; and a plurality of manually tossable rings so that when a ring is placed on said first king pin said rocker rocks and when a ring is tossed onto said second king pin said rocker rocks in a direction so that said ring on said first king pin can be tossed thereoff.

7. A ring toss game comprising:

a rocker, said rocker having a body having ends and having a curved bottom surface intermediate its ends, said rocker body being shaped so that it can rock on its curved bottom surface;

a leveling structure on said rocker body;

first and second king pins generally directed towards each other and positioned on said rocker body adjacent its ends; and a plurality of manually tossable rings so that, when said rocker is unbalanced by rings thereon, said rocker can be rebalanced by adjustment of said leveling structure.

8. The ring toss game of claim 7 wherein said leveling structure comprises a weight on said rocker body which is relatively movable with respect to said rocker body.

9. The ring toss game of claim 8 wherein there are base scoring pins secured to said rocker body intermediate the ends thereof, said base scoring pins being positioned and directed so that they can receive rings from said king pins.

10. A ring toss game comprising:

a rocker body, said rocker body having ends and having a curved bottom surface intermediate its ends, said rocker body being shaped so that it can rock on its curved bottom surface;

first and second king pins generally directed towards each other and positioned on said rocker body adjacent its ends so that when a ring is placed on one of said king pins said rocker rocks, base scoring pins secured to said rocker body intermediate the ends thereof, said base scoring pins being positioned and directed so that they can receive rings from said kingpins.

* * * * *